US009475326B2

(12) United States Patent
Petersen

(10) Patent No.: US 9,475,326 B2
(45) Date of Patent: Oct. 25, 2016

(54) REMOVABLE DIE PLATE FOR SELF-INKING STAMPS

(71) Applicant: Millennium Marking Company, Elk Grove Village, IL (US)

(72) Inventor: Craig Petersen, Elk Grove Village, IL (US)

(73) Assignee: Trodat GmbH (AT)

( * ) Notice: Subject to any disclaimer, the term of this patent is extended or adjusted under 35 U.S.C. 154(b) by 0 days.

(21) Appl. No.: 14/481,446

(22) Filed: Sep. 9, 2014

(65) Prior Publication Data

US 2016/0067994 A1 Mar. 10, 2016

(51) Int. Cl.
*B41K 1/36* (2006.01)
*B41K 1/54* (2006.01)

(52) U.S. Cl.
CPC ..... *B41K 1/54* (2013.01)

(58) Field of Classification Search
CPC ..... B41K 1/38; B41K 1/15; B41K 1/56; B41K 1/006; B41K 1/02; B41K 1/00
See application file for complete search history.

(56) References Cited

U.S. PATENT DOCUMENTS 4,172,419 A * 10/1979 Munyon ..... 101/379
4,998,473 A * 3/1991 Laureyns ..... 101/333
5,048,415 A * 9/1991 Shih ..... 101/103
5,438,929 A * 8/1995 Wong et al. ..... 101/405
5,533,642 A * 7/1996 Lafond et al. ..... 220/326
5,575,399 A * 11/1996 Intini ..... 220/835
5,709,145 A * 1/1998 Shih ..... 101/109
5,942,312 A 8/1999 Venkataraman et al.
6,679,165 B2 1/2004 Shih
6,679,168 B1 * 1/2004 Shih ..... 101/333
6,968,781 B1 11/2005 Petersen
7,011,024 B1 * 3/2006 Shih ..... 101/334
7,124,684 B1 * 10/2006 Petersen ..... 101/333
2003/0089258 A1 * 5/2003 Rigoni ..... 101/405
2003/0150343 A1 * 8/2003 Koneczny ..... 101/333

FOREIGN PATENT DOCUMENTS

JP 2001121798 A * 5/2001

* cited by examiner

*Primary Examiner* — David Banh

(74) *Attorney, Agent, or Firm* — Lerner, David, Littenberg, Krumholz & Mentlik, LLP

(57) ABSTRACT

A stamp die assembly for a self inking stamp in which the die plate having printing indicia thereon is easily removable from the die frame. There is a movable latch on the die plate that is received by a catch or slot in the die frame to lock the die plate to the die frame. By pushing on a push button the catch is moved from the locked position to the unlocked position in which the latch is released from the catch. A spring returns the latch to the original or locked position.

16 Claims, 4 Drawing Sheets

REMOVABLE DIE PLATE FOR SELF-INKING STAMPS

BACKGROUND OF THE INVENTION

This invention relates to hand stamps and more particularly to a self-inking hand stamp. Self inking stamps are one type of hand stamp that are used to create ink impressions on paper or other materials. The self-inking stamps allow the user to continuously stamp pieces of paper or other materials by merely continuously depressing the operating handle. The handle actuates a reciprocating die frame that has a die plate with the printing indicia thereon. The die plate contacts an ink pad to be re-inked each time an impression is made. Generally the die plate reciprocates in a stamp frame to contact the ink pad and then rotates 180° to contact the paper surface on which it prints the impression.

One example of a self inking stamp is illustrated in U.S. Pat. No. 7,124,684. It can be seen in the '684 patent that there is an actuating handle that when depressed causes the stamp insert and printing plate to reciprocate between the raised inking position in which the printing plate contacts an ink pad, and the lowered or printing position in which the printing plate contacts the printing surface. Another example of a self inking stamp is illustrated in U.S. Pat. No. 7,011,024. This patent also illustrates a self-inking stamp that has a removable stamp die that is detachably mounted to a bracket that reciprocates when the handle of the stamp is actuated. As such it can be seen that self inking stamps are known in the art. The present invention is related to these self inking stamps but is directed to a uniquely removable die plate that allows the user to easily replace one die plate with another. This allows the user to replace a worn die plate or a die plate with a different impression thereon without throwing out the hand stamp.

SUMMARY OF THE INVENTION

The self-inking stamp has a stationary stamp frame on which is mounted an actuating handle that is operatively connected to a reciprocating die frame. The die frame has the die plate with a printing plate mounted on its bottom surface to transfer the image from the printing plate to the printing surface. An ink pad is mounted in the stamp frame so that the printing plate attached to the die plate contacts the ink pad each time the actuating handle is forced by means of springs to its upward position. In this manner continuous printing can be accomplished by the user. In another embodiment the die plate has an ink supply within the die plate so that the printing plate is continuously supplied with ink without the need for contacting a separate ink pad.

The die plate has an opposite pair of latches that are received in slots on cross braces on the die frame so that the latches are locked in place by in the slots by locking tabs or barbs located on the latches. The latches are spring loaded so that they snap in place in the slots on the cross braces on the die frame, yet can be released by the user applying pressure to the latches to move them out of engagement with the slots so that they can be released from the slots. The tops of the latches are tapered or beveled so that they will allow for some misalignment when the die frame is initially positioned and pushed onto the die plate so that it is easier for the user to attach the die plate to the die frame. This design allows the user to easily change die plates so that one stamp can be used for many stamping images by merely changing the die plates.

DESCRIPTION OF THE PREFERRED EMBODIMENT

Figure 1:
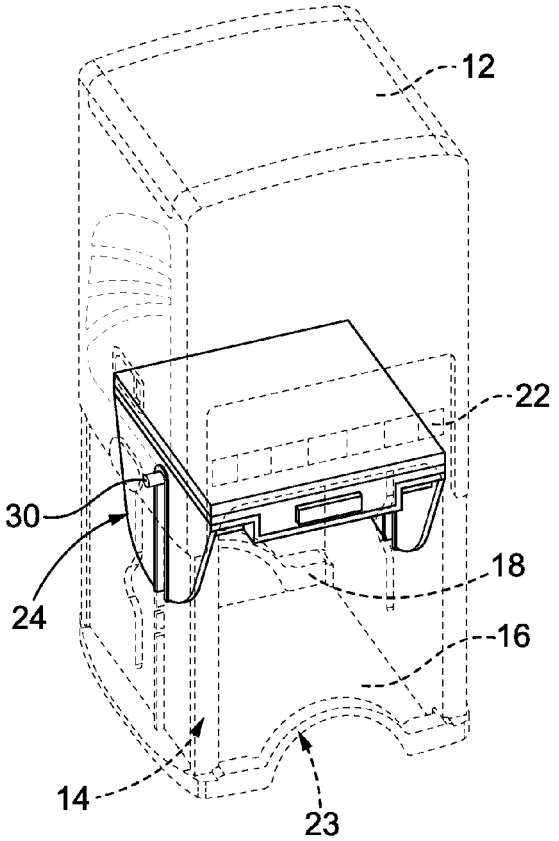
FIG. 1 is a perspective view of the self-inking stamp shown in dotted lines with the die frame and die plate in the top position to contact the ink pad within the stamp frame.

Turning first to FIG. 1, there is illustrated a hand stamp 10 in dashed lines that incorporates the present invention. The stamp 10 is a self inking stamp as described above and has an operating mechanism as previously taught in the prior art. There is an actuating handle 12 which can be provided with a locking mechanism (not illustrated) that allows the user to lock the actuating handle in the lowered or depressed position. Various locking mechanisms are taught in the prior art which can be self releasing or require the user to manually operate a slide or button to release the actuating handle 12. The stamp 10 has a front frame 16, a rear frame 18 and frame sides 20. An ink pad slot 22 is provided to receive an ink pad. The front frame 16 and rear frame 18 have a thumb cutout or indentation 23.

Figure 2:
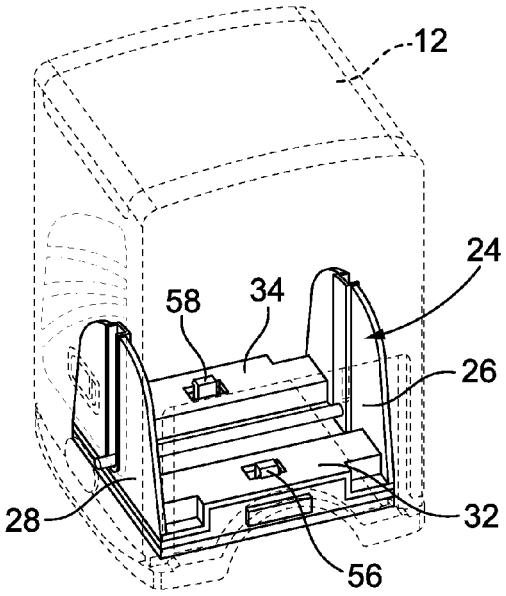
FIG. 2 is a perspective vie of the self-inking stamp shown in dotted lines with the die frame and die plate in the bottom or printing position with the actuating handle in the depressed position.
Figure 4:
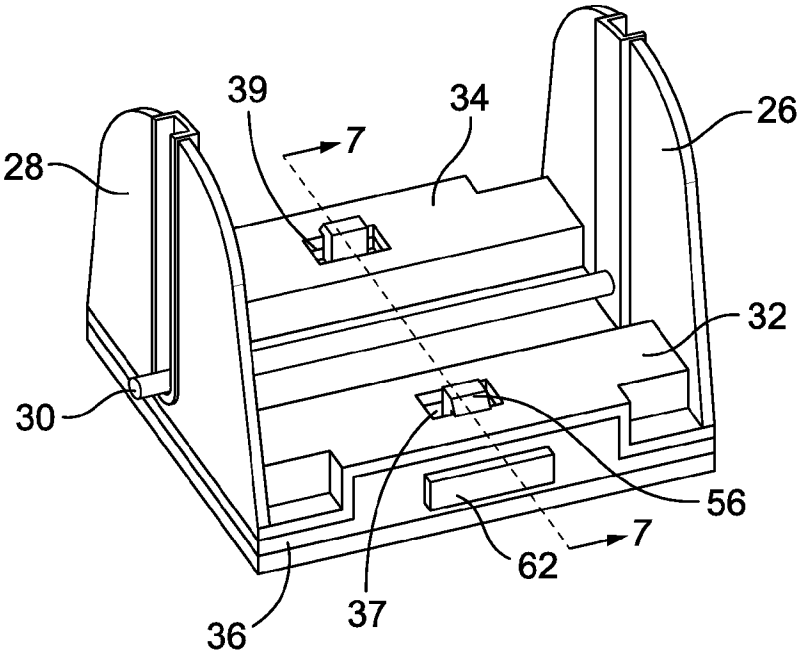
FIG. 4 is front top perspective view of the assembled die frame and die plate.

A die frame 24 is mounted to a reciprocating mechanism that is mounted in the actuating handle 12. The reciprocating mechanism causes the die frame 24 to rotate 180° from the raised or upper position in which the die frame faces the ink pad in the slot 22 and a lowered position in which the die frame 24 rotates and faces the printing surface, such as illustrated in FIG. 2.

Figure 3:
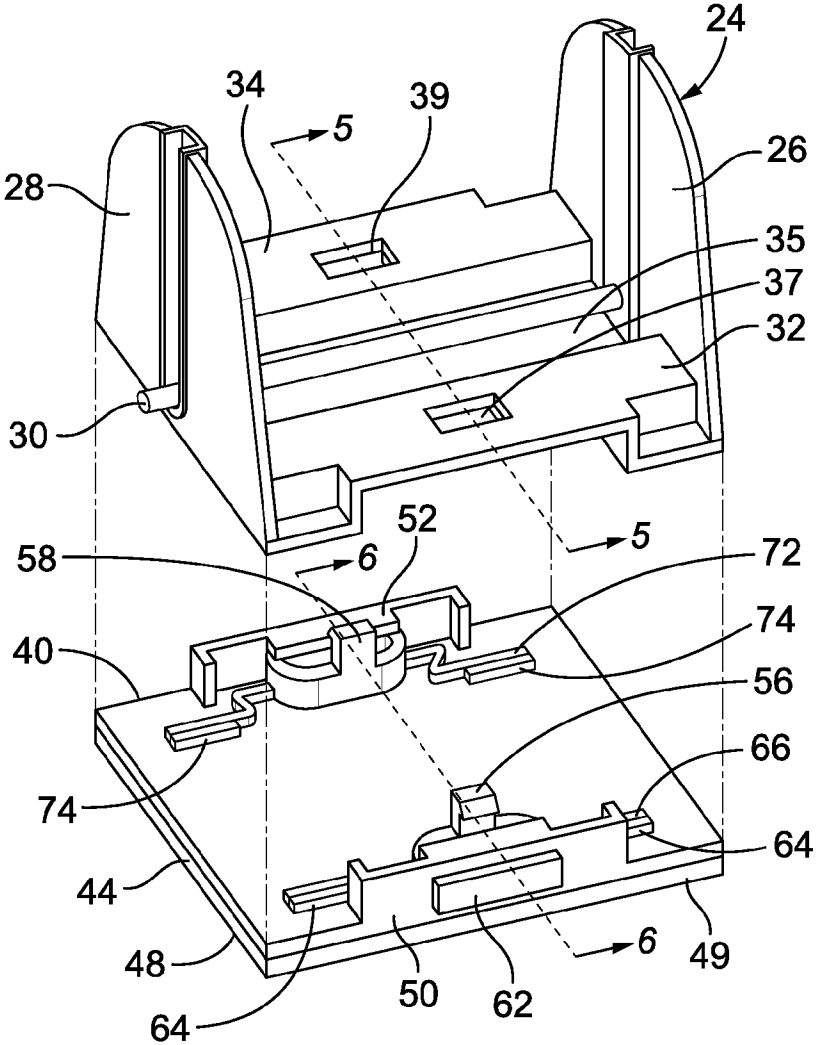
FIG. 3 is a top front perspective exploded view showing the die frame released from the die plate.
Figure 5:
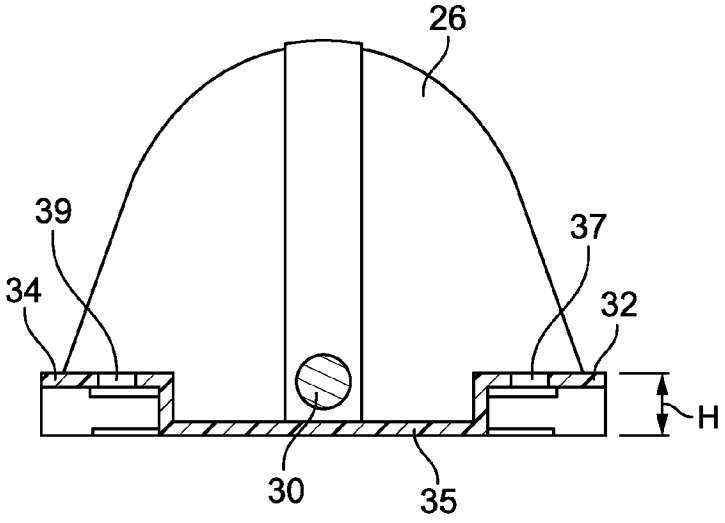
FIG. 5 is a cross sectional view taken along line 5-5 of FIG. 3 of the die frame and pivot pin.

The die frame 24 is most clearly illustrated in FIG. 3. There is a right support 26 and an opposite left support 28. A pivot rod 30 passes through the left and right supports 26, 28 and provides the pivot point about which the die frame 24 rotates from its raised to lowered positions. There is a front cross brace 32 and a rear cross brace 34 located respectively at the front and rear of the die frame 24. The front cross brace 32 has a front slot or opening 37 and the rear cross brace 34 has a rear slot or opening 39 disposed at the center of their respective braces. Although the term slot 37 and 39 is used to describe this element, it also may be referred to herein as a "catch". The front and rear cross braces 32, 34 are connected by a bridging member 35. The cross braces 32 and 34 have a height "H" that will be described in greater detail below.

Also illustrated in FIG. 3 is a die plate 36 that has a front 38, a rear 40, and opposite sides 42, 44. The die plate 36 also has a top surface 46 and a bottom surface 48. Attached to the bottom surface 48 is a printing plate 49 that has printing indicia thereon. The printing plate 49 is of the type commonly used in stamps and is generally made of rubber with raised printing indicia that contacts the ink pad when the die frame is rotated into its raised position as illustrated in FIG. 1.

Figure 6:
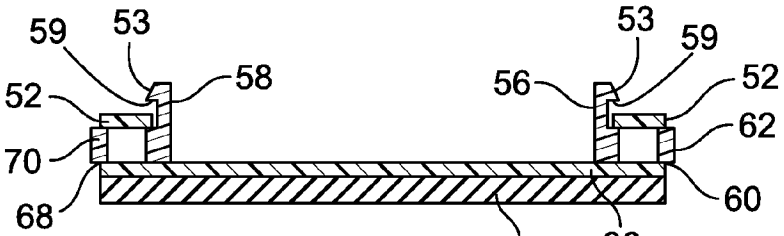
FIG. 6 is a cross section view taken along line 6-6 of FIG. 3 of the die plate and tabs.

Mounted on or integrally formed with the die plate 36 is an upstanding front retaining member 50 and an upstanding rear retaining member 52. There is a front latch 56 and a rear latch 58. The top surface of the latches 56 and 58 taper downwardly and out as clearly seen in FIGS. 6 and 7. The latches 56 and 58 have a lower shoulder 59.

The front latch 56 is mechanically connected through a slot 60 in the front retaining member 50 to a front push button 60. A front spring 64 pushes the front latch 56 out from the center of the die plate 36 so that the front pushbutton 62 is pushed outward. The front spring 64 is retained on the die plate 36 by means of a stop 66. The rear latch 58 is likewise mechanically connected through a slot 68 in the rear retaining member 52 to a rear pushbutton 70. A rear spring 72 pushes the rear latch 58 out from the center of the die plate 36 so that the rear pushbutton 72 is pushed outward. The rear spring 72 is retained on the die plate 36 by means of a stop 74. By the user pushing on the pushbuttons 62 and 70 with sufficient force to overcome the spring forces 64 and 72 respectively, the user can slide the front and rear latches 56 and 58 horizontally over the top surface 46 within the range of movement provided by the pushbuttons 62 and 70 and their respective mechanical connections to the latches 56 and 58.

To attach the die plate 36 to the die frame 24 the user places the die plate 36 with the printing plate 49 in the down or printing position inside the area defined by the front frame 16, rear frame 18 and frame sides 20. The user pushes down on the actuating handle 12 which forces the die frame 24 downward. The outer edge of the slots or catches 37 and 39 strike the tapered top edge 53 of the front and rear latches 56, 58 respectively. The size of the front and rear latches 56, 58 is smaller than the slots 37, 39 to allow the latches 56, 58 to enter the slots 37, 39 respectively. The tapered top edge 53 on the latches 56, 58 further assists in positioning the latches 56, 58 within the slots 37, 39.

Figure 7:
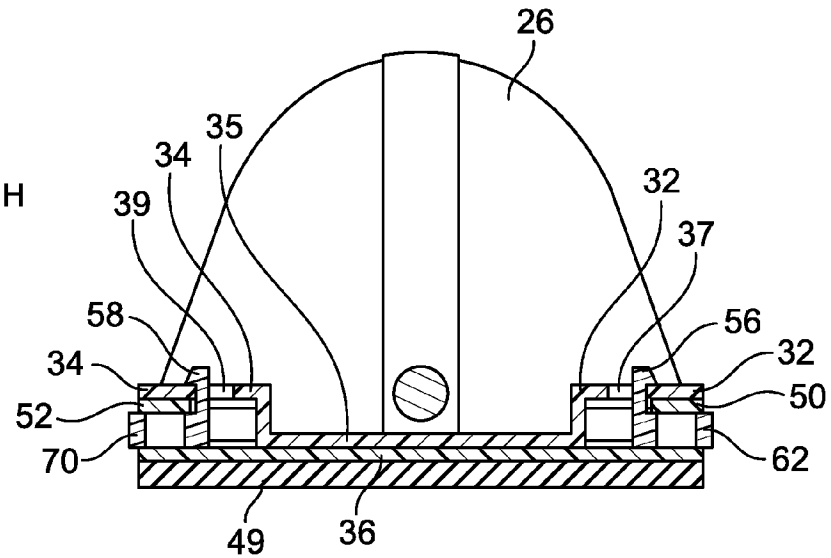
FIG. 7 is a cross section view taken along line 7-7 of FIG. 4 of the die frame, die plate and latches in the locked, assembled position ready for printing.

The downward force applied to the actuating handle 12 pushes the latches 56, 58 against the slots 37, 39 in the front cross brace 32 and rear cross brace 34. This causes the front latch 56 and rear latch 58 to slide inward allowing the front retaining member 50 and rear retaining member 52 to slide over the top tapered surface 53 of the latches 56, 58 until the top of the front retaining member 50 and top of the rear retaining member 52 slides past the shoulder 59 at which point the front and rear latches spring back into their original position due to the force exerted by the springs 64 and 72 with the front and rear latches 56, 58 locked in place below the shoulder 59 of the latches 56, 58 respectively as seen in FIG. 7. The height "H" of the front and rear cross braces 32, 34 is sufficient to allow the front and rear retaining members 50, 52 to fit underneath the height "H". Thus the die plate 36 is firmly locked in place against the die frame 24.

To release the die plate 36 from the die frame 24, the user inserts his fingers through the front and rear indents 23 and pushes the front pushbutton 62 and rear pushbutton 70 inwardly. This pushes the front and rear latches 56, 58 inward so that the shoulder 59 clears the front cross brace 32 and rear cross brace 34. The die plate is thus released from the die frame 24. The user can then attach another die plate with other printing indicia thereon to the die frame 24 rather than replacing the entire hand stamp 10. Also when the printing plate 49 wears out, it can be replaced without replacing the entire stamp 10. Inventory is reduced as the user only needs to store differing die plates 36 rather than an entire stamp 10.

It should be noted that by pushing inward on the front pushbutton 62 and rear pushbutton 70, the die plate 36 can be attached to the die frame 24. When the force to the pushbuttons is released, the latches 56, 58 will lock the die plate 36 to the die frame 24. This process is the reverse of the process used to remove the die plate described above.

The embodiment illustrates slots 37, 39 in the die frame 24 to receive the front and rear latches 56, 58, it is readily apparent that the slots can be replaced by any member that acts as a catch such as a cross brace or cross bar or similar structure that receives the latches 56, 58 in locking engagement.

Although the above described embodiment illustrates two latches to secure the die plate 36 to the die frame 24, it can be built using only one moveable latch. In this alternate embodiment one of the latches will be stationary and secure one side of the die plate to the frame while only the other latch will move into and out of engagement with the cross brace.

Figure 8:
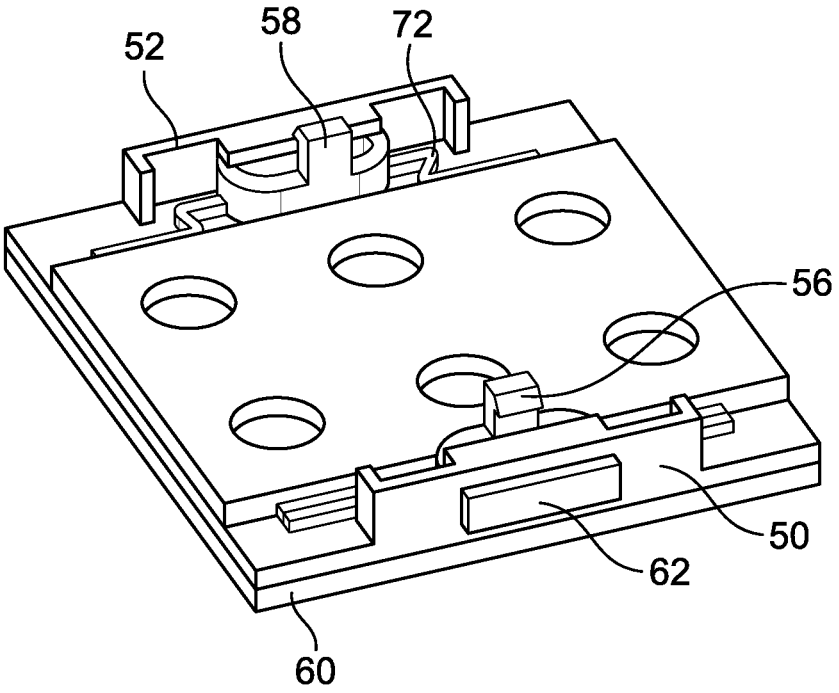
FIG. 8 is a front top perspective view of an alternative embodiment of the die plate having a pre-inked pad for providing ink to the printing surface of the die plate.

FIG. 8 illustrates an alternate embodiment of a die plate 58 having a printing plate or surface 60. This embodiment uses a pre-inked thermoplastic foam that allows ink to pass through certain areas of the foam and not through others, thereby forming the image that is to be printed. Examples of this technology are illustrated in U.S. Pat. No. 5,942,312 and U.S. Pat. No. 6,968,781, both patents incorporated herein by reference. Thus, the ink pad placed in the slot 22 is eliminated. In other respects the die plate 58 is attached to the die frame 24 in the same manner as previously described in the first embodiment.

Thus there has been provided a removable die plate for self-inking stamps. While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A stamp die assembly for a self inking stamp comprising:

a die frame having first and second slots and having a downwardly-facing surface;

a die plate having oppositely facing top and bottom surfaces, the bottom surface configured to receive a printing plate, the top surface configured to be juxtaposed with the downwardly-facing surface of the die frame, the die plate having first and second latching members thereon and front and rear push-buttons on the die plate positioned at a front and a rear of the die plate, respectively the front and rear pushbuttons remote from locations of the first and second latching members, respectively, the front and rear pushbuttons movable in first and second opposite directions, respectively, to move the first and second latching members in the first and second directions, respectively, thereby moving the first and second latching members from first positions in which the latching members are in locking engagement with the first and second slots, respectively, to second positions in which the latching members are disengaged from the locking engagement with the first and second slots, respectively; and a spring configured to move each latching member from the second position to the first position.

2. The stamp die assembly for a self inking stamp of claim 1 wherein the latching members have top edges that are tapered that engages the slots to assist in aligning the die plate with the die frame.

3. The stamp die assembly for a self inking stamp of claim 1 wherein the spring is mounted on the die plate and continuously engages the latching members to maintain a force on the latching members at all times.

4. The stamp die assembly for a self inking stamp of claim 1 and further comprising the printing plate received by the bottom surface of the die plate, the printing plate having printing indicia thereon.

5. A die plate for a self inking stamp comprising:

oppositely facing top and bottom surfaces, and front and rear surfaces extending in a direction transverse to the top and bottom surfaces, the bottom surface configured to receive a printing plate, the top surface configured to be juxtaposed with a downwardly-facing surface of a frame of the self inking stamp, the die plate having first and second latches thereon, front and rear pushbuttons at the front and rear-surfaces of the die plate mechanically coupled with the first and second latches and remote from locations of the first and second latches, respectively, and configured to affix the die plate with the frame of the self inking stamp, the front and rear pushbuttons being movable in first and second opposite directions, respectively, to thereby move the first and second latches in first and second directions, respectively from the first position to the second position when the front and rear pushbuttons are depressed.

6. The die plate for a self inking stamp of claim 5 and further comprising a spring for applying forces to the first and second latches to push the first and second latches from the second position to the first position when the external force is removed from the front and rear pushbuttons.

7. A stamp die assembly for a self inking stamp comprising the die plate of claim 5 and further comprising the frame, the frame comprising first and second catches for receiving the first and second latching members.

8. The stamp die assembly for a self inking stamp of claim 7 wherein the first and second latches have top edges that are tapered that engages the first and second catches, respectively, to assist in aligning the die plate with the frame.

9. A stamp die assembly for a self inking stamp comprising:

a die frame having opposed upstanding side walls substantially parallel to each other;

a cross brace extending between the upstanding side walls;

a catch on the cross brace;

a die plate having a front and rear surfaces and opposite sides, a top surface and a bottom surface, the front and rear surfaces arranged on a shorter separation than the opposite sides;

a printing plate on the bottom surface of the die plate, the printing plate having printing indicia thereon;

first and second latches adjacent to the front and rear surfaces of the die plate;

the first and second latches engaging the catch in locking engagement to secure the die plate to the die frame; and front and rear pushbuttons at the front and rear surfaces of the die plate, the front and rear pushbuttons remote from locations of the front and rear latches, respectively, and movable in a-first and second opposite directions to thereby move the first and second latches in the first and second directions, respectively, out of locking engagement to release the die plate from the die frame.

10. The stamp die assembly for a self inking stamp of claim 9 and further comprising a spring for applying a force to the first and second latches to push the first and second latches from second positions in which the latches are out of the locking engagement with the catch to first positions in which the latches are in locking engagement with the catch.

11. The stamp die assembly for a self inking stamp of claim 9 wherein the catch on the cross brace for receiving the latches is a slot in the die frame for receiving the latches.

12. The stamp die assembly for a self inking stamp of claim 9 wherein the latches have top edges that are tapered that engage the catch to assist in aligning the die plate with the die frame.

13. The stamp die assembly of claim 1, wherein the front and rear pushbuttons extend through a slot in the front and rear surfaces of the die plate, respectively, the front and rear surfaces extending at an angle to a bottom surface of the die plate.

14. The stamp die assembly of claim 1, wherein the front and rear pushbuttons extend through a slot in the front and rear surfaces of the die plate, respectively, the front and rear surfaces extending at an angle to a bottom surface of the die plate.

15. The stamp die assembly for a self inking stamp of claim 9 wherein the catch on the cross brace for receiving the latches are first and second catches on first and second cross braces, respectively.

16. The stamp die assembly for a self inking stamp of claim 1, wherein the die frame is pivotable about an axis from a first die frame position in which the die plate is retracted in which the lower surface faces a first direction and a second die frame position in which the lower surface faces a second direction and in which the die plate faces a printing surface.

* * * * *